United States Patent [19]

Chen

[11] Patent Number: 5,030,026

[45] Date of Patent: Jul. 9, 1991

[54] LEAKPROOF FOUNTAIN PEN WITH BALLBEARING TIP

[76] Inventor: Ching-Fei Chen, No. 35-43, An-Si Li, Chia-Li Chiang, Tainan, Taiwan

[21] Appl. No.: 477,052

[22] Filed: Feb. 7, 1990

[51] Int. Cl.[5] ..... B43K 7/03; B43K 5/18; B43K 5/10

[52] U.S. Cl. ..... 401/209; 401/229; 401/230; 401/151

[58] Field of Search ..... 401/209, 225, 229, 230, 401/151

[56] References Cited

U.S. PATENT DOCUMENTS

| | | | |
|---|---|---|---|
| 1,980,625 | 11/1934 | Laforest | 401/217 X |
| 2,260,561 | 10/1941 | Johndohl | 401/229 X |
| 2,602,423 | 7/1952 | Smith | 401/209 X |
| 3,873,218 | 3/1975 | Yoshida | 401/209 X |
| 4,509,876 | 4/1985 | Hori | 401/209 X |
| 4,556,336 | 12/1985 | Sano et al. | 401/225 X |
| 4,671,692 | 6/1987 | Inaba | 401/209 X |
| 4,712,937 | 12/1987 | Schmidt et al. | 401/209 X |

FOREIGN PATENT DOCUMENTS

| | | | |
|---|---|---|---|
| 256615 | 2/1988 | European Pat. Off. | 401/209 |

*Primary Examiner*—Danton D. DeMille
*Attorney, Agent, or Firm*—Jeffers, Hoffman & Niewyk

[57] ABSTRACT

A leakproof fountain pen with a ballbearing tip includes an upper casing threadedly engaged to an ink flow guide. An ink reservoir has an open end received by an annular base of the ink flow guide. The upper casing combines with the ink flow guide to form a chamber for collecting ink which may flow from the ink reservoir. The ink flow guide further comprises an axial vent hole communicated with the atmosphere; an axial ink hole to serve as a path for ink flowing to and from the chamber and the ink reservoir; and an axial control hole having a flow portion with a bigger diameter. A gravity post is movably disposed inside the flow portion and can block the passage of ink between the ink reservoir and the control hole. A plug unit acts as a support for the gravity post. A first end of the ink flow guide is substantially V-shaped with the lowest point at the opening of the ink hole to direct the collected ink from the chamber towards the ink hole when the pen is held upright. The air inside the ink reservoir is communicated with the atmosphere through the vent hole and the ink hole.

2 Claims, 4 Drawing Sheets

LEAKPROOF FOUNTAIN PEN WITH BALLBEARING TIP

BACKGROUND OF THE INVENTION

This invention relates to a fountain pen with a ballbearing tip, more particularly to a leakproof fountain pen with a ballbearing tip.

Fountain pens with ballbearing tips are known in the art. However, not enough protection is provided by these pens to prevent the leakage on ink when the pen is vigorously shaken.

SUMMARY OF THE INVENTION

Therefore, the object of this invention is to provide a leakproof fountain pen which prevents the leakage of ink when the pen is vigorously shaken.

More specifically, the object of this invention is to provide a chamber for collecting ink which flows out of the ink reservoir when the pen is vigorously shaken, and to provide means for returning the collected ink from the chamber to the ink reservoir.

Accordingly, a leakproof fountain pen of this invention comprises an upper casing threadedly engaged to an ink flow guide. The upper casing combines with the ink flow guide to form a chamber for collecting ink. The ink flow guide and the upper casing have an axial tube hole formed in their respective bodies for receiving a siphon tube. The siphon tube has one end communicated with a ballbearing tip and another end communicated to an ink reservoir received by an annular base of the ink flow guide. The ink flow guide further comprises an axial vent hole communicated with the atmosphere; an axial ink hole to serve as a path for ink flowing to and from the chamber and the ink reservoir; and an axial control hole having a flow portion with a bigger diameter. A gravity post is movably disposed inside the flow portion and can block the passage of ink between the ink reservoir and the control hole. A plug unit acts as a support for the gravity post. A first end of the ink flow guide is substantially V-shaped with the lowest point at the opening of the ink hole to direct the collected ink from the chamber towards the ink hole when the pen is held upright. A pen barrel has an air hole to communicate the air inside the ink reservoir with the atmosphere through the vent hole and the ink hole.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
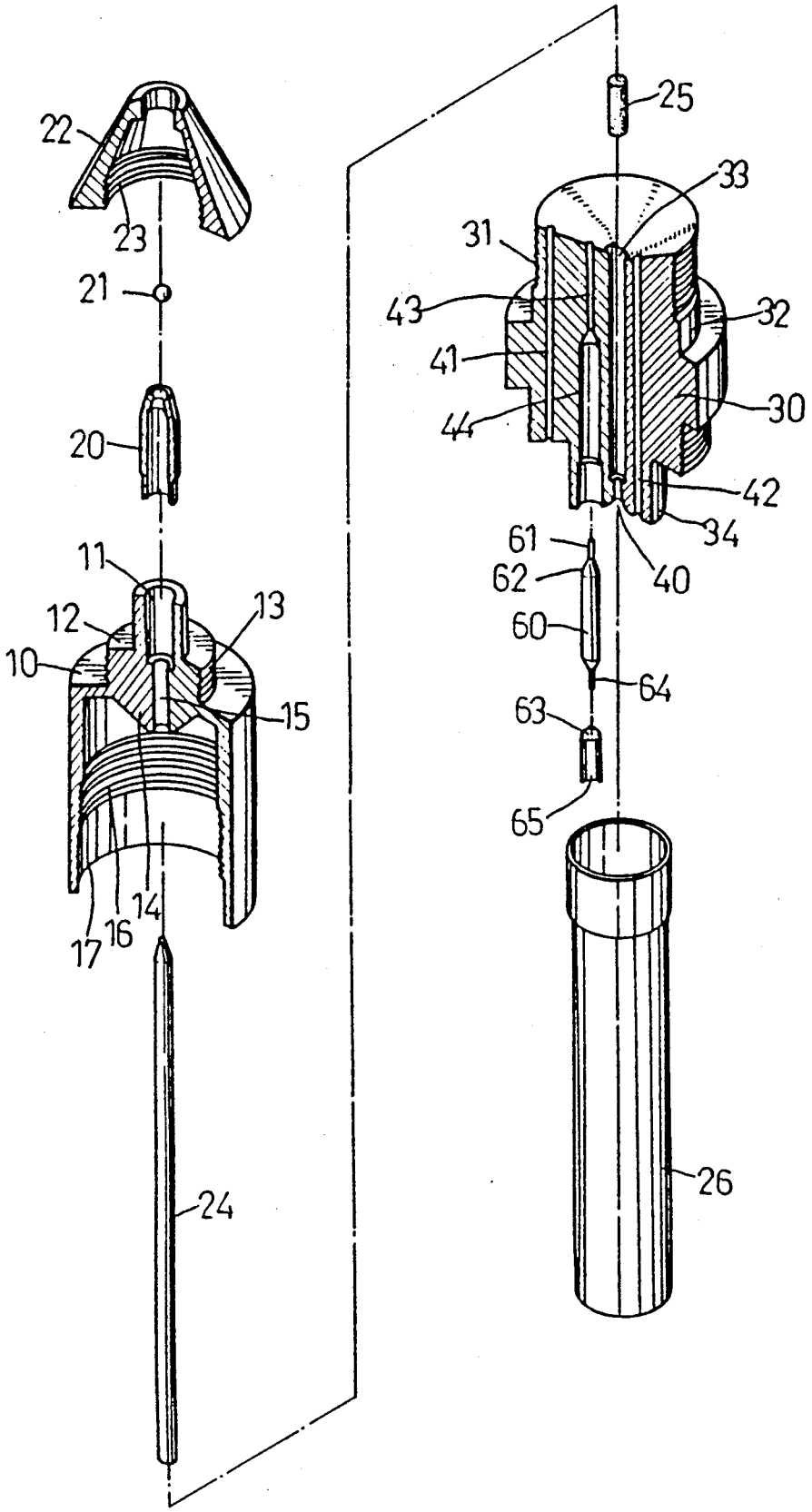
FIG. 1 is an exploded view of a preferred embodiment according to this invention.
Figure 2:
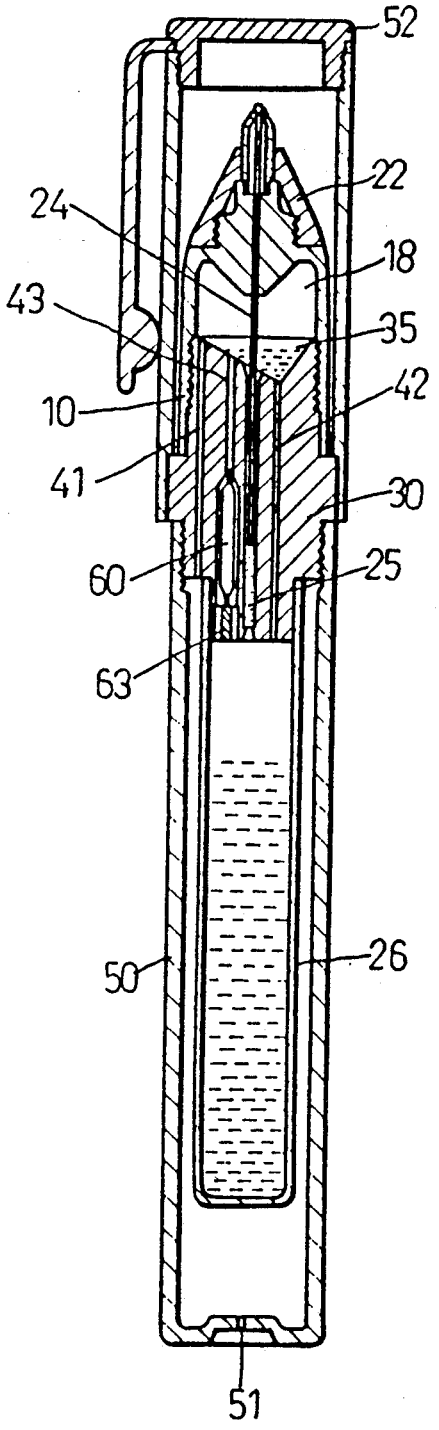
FIGS. 2, 3, 4 are sectional views of the embodiment of FIG. 1.

Referring to FIGS. 1, 2, a fountain pen according to this invention comprises an upper casing 10, a writing point 20, an ink flow guide 30 and a pen barrel 50.

The upper casing 10 is substantially cylindrical and has an opening 11 for receiving the writing point 20. A ballbearing 21 is fixed on one end of the writing point

20. An annular shoulder 12 is formed near the opening 11 and external screw threads 13 are formed on the annular shoulder 12. A head 22 is formed as a hollow, substantially conical wall and has internal screw threads 23 for engaging with the external screw threads 13 of the upper casing 10. The upper casing 10 has a cone-like projection 14 projecting downwards inside the upper casing 10 from the base of the annular shoulder 12. An axial opening 15 is formed in the cone-like projection 14. A siphon tube 24 is disposed inside the axial opening 15 and has a pointed end communicated with the ballbearing 21. The siphon tube 24 has irregular inner radial slits to achieve a capillary flow of ink towards the ballbearing 21.

The upper casing 10 further comprises internal screw threads 16 formed midway inside the upper casing 10. The ink flow guide 30 has a first end formed with external screw threads 31 for engaging with the internal screw threads 16 of the upper casing 10. When engaged, a binding surface 17 of the upper casing 10 fits tightly with a binding surface 32 of the ink flow guide 30 in order to prevent leakage and thus achieve a sealing effect. A tube hole 33 is axially formed at the center of said ink flow guide 30 and has an ink absorbent cotton 25 resting on one end of the tube hole 33. Another end of the siphon tube 24 is communicated with the ink absorbent cotton 25 inside said tube hole 33. An ink reservoir 26 is attached to an annular base 34 of the ink flow guide 30 and communicates with the ink absorbent cotton 25 through a trumpet opening 40 of the tube hole 33.

The pen barrel 50 is threadedly engaged to the bottom part of the ink flow guide 30. An air hole 51 is formed at the bottom of the pen barrel 50 so as to communicate the air inside the pen barrel 50 with the outer surroundings, thereby maintaining atmospheric pressure inside the pen barrel 50. The fountain pen further comprises a cover 52 detachably engaged to the upper casing 10.

Figure 3:
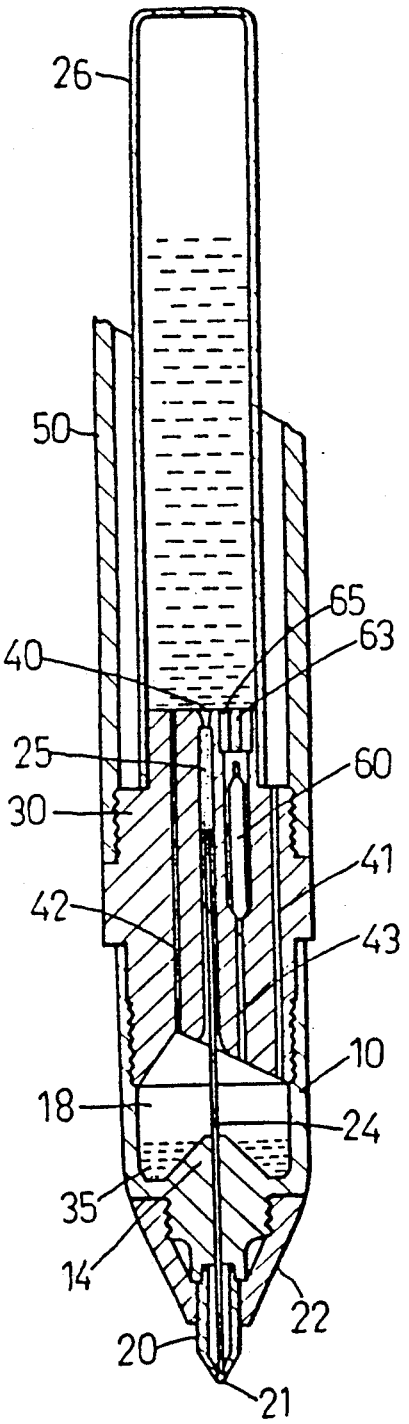

Referring to FIG. 3, the ink flow guide 30 further comprises a vent hole 41, an ink hole 42, and a control hole 43 all of which are oriented in the axial direction. The control hole 43 has a flow portion 44 which has a bigger diameter and receives a gravity post 60 inside said flow portion 44. The ink flow guide 30 further comprises a substantially cylindrical plug 63 with a plurality of axial through grooves 65 on its outer surface. The plug 63 is received by the control hole 43 and supports the gravity post 60. When the fountain pen is in a writing position, a guiding rod 61 of the gravity post 60 protrudes inside the control hole 43 and a conical surface 62 of the gravity post 60 is received by a similar surface of the flow portion 44, blocking ink from passing through the axial grooves 65 of the plug 63 towards the control hole 43. The air from the air hole 51 of the pen barrel 50 communicates with the air inside the ink reservoir 26 through reservoir 18 and the ink hole 42 (FIG. 3). The ink from the ink reservoir 26 flowing into the trumpet opening 40 is absorbed by the ink absorbent cotton 25 and flows into the siphon tube 24 and to the surface of the ballbearing 21, thus allowing ink to be transferred to a writing surface. Ink does not pass through the ink hole 42 because of its relatively small size and the friction between the ink hole 42 and the ink.

When the equilibrium state of the fountain pen is disturbed by vigorous shaking, the centrifugal force adds to the sealing effect of the gravitiy post 60 on the control hole 43. The ink will flow from the ink reservoir 26 through the ink hole 42 and/or through the tube hole 33 at the peripheral edges of the siphon tube 24. A chamber 18 formed between the upper casing 10 and the ink flow guide 30 collects the flowing ink and prevents it from leaking out of the fountain pen.

Figure 4:
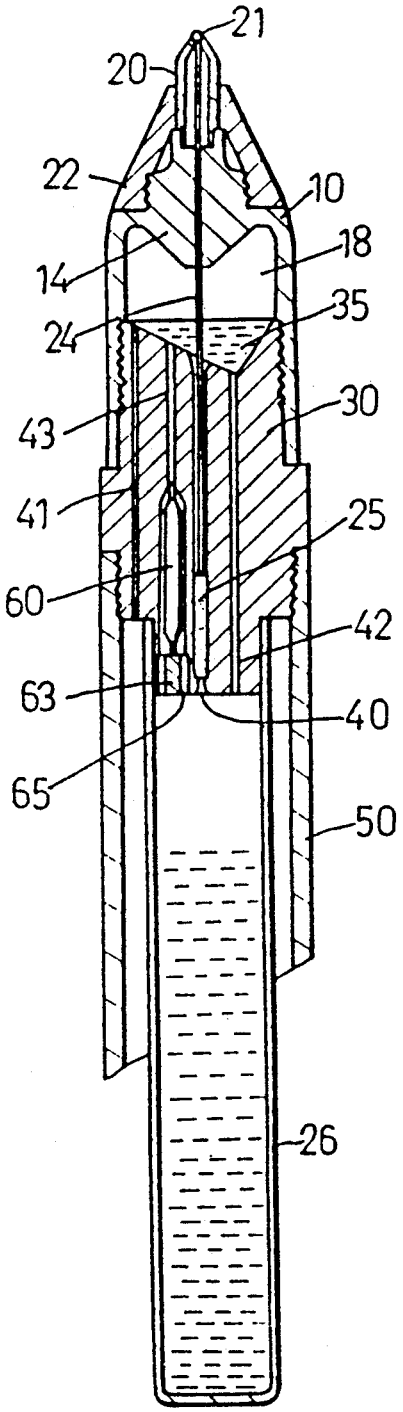

Referring to FIG. 4, the preferred embodiment is shown in a direction opposite of that in FIG. 3. The gravity post 60 has a second end 64 similar in shape to the guiding rod 61. Under this condition, the second end 64 rests on the plug 63 and does not block the control hole 43. The air trapped inside the chamber 18 will force the collected ink 35 in the chamber 18 to flow down the control hole 43, pass through the plurality of axial grooves 65 of the plug 63 and back into the ink reservoir 26. The ink hole 42 also serves as another path for the collected ink 35 to return to the ink reservoir 26. The collected ink 35 will not be able to pass through the vent hole 41 because of surface tension. The first end of the ink flow guide 30 is substantially V-shaped, with the lowest point at the opening of the ink hole 42. This make it easier for the collected ink 35 to flow through the ink hole 42.

When the fountain pen is in a horizontal position, the gravity post 60 may or may not block the control hole 43. Ink may flow freely to and from the ink reservoir 26 and the chamber 18 through the ink hole 42 and the control hole 43, if the control hole 43 is not blocked by the gravity post 60. Ink cannot flow from the chamber 18 through the vent hole 41 nor through the air hole 51 of the pen barrel 50 because of surface tension and the air blocking the passageway of the vent hole 41.

Figure 5:
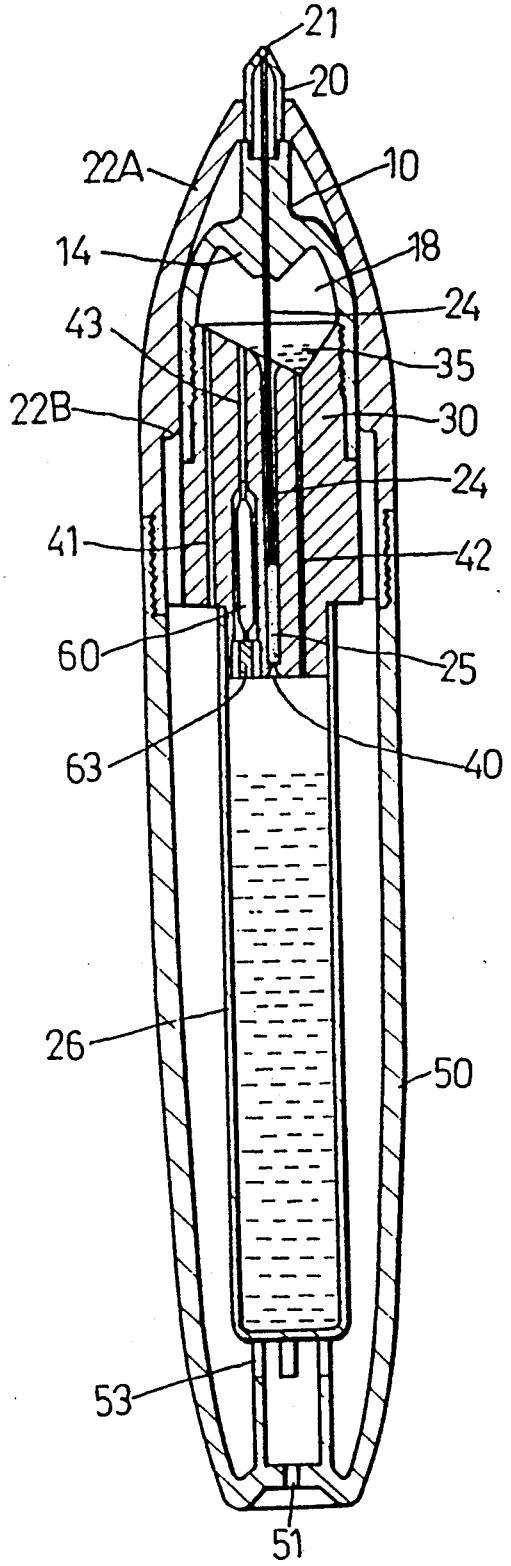
FIG. 5 is a sectional view of a second preferred embodiment according to this invention.

A sectional view of a second preferred embodiment is shown in FIG. 5. The head 22A is threadedly engaged to the pen barrel 50. The inner surface of the head 22A has an inwardly projecting surface 22B which tightly grips the upper casing 10. In this embodiment, the ink flow guide 30 is not threadedly engaged to the pen barrel 50. The pen barrel 50 supports the ink reservoir 26 at its bottom end. Second air holes 53 formed on the base support serve as a path for communicating the air from the air hole 51 to the vent hole 41.

While the present invention has been described in connection with what is considered the most practical and preferred embodiment, it is understood that the invention is not limited to the disclosed embodiments, but is intended to cover various arrangements included within the spirit and scope of the broadest interpretation so as to encompass all such modifications and equivalent arrangements.

I claim:

1. A fountain pen which includes a ballbearing tip; an ink reservoir for receiving ink; and a siphon tube having one end communicated with said ballbearing tip and a second end communicated with said received ink, said received ink flowing in a capillary action inside said siphon tube; said fountain pen further comprising:

an ink flow guide disposed between said ink reservoir and said ballbearing tip, said ink flow guide cooperating with said ballbearing tip to form a chamber for collecting ink, said ink flow guide having a lower portion sealingly engaged with said ink reservoir, an axially oriented tube hole for receiving said siphon tube, a vent hole for communicating the air inside said chamber with the atmosphere, and an ink hole oriented in the axial direction which communicates said chamber to said ink reservoir;

said ink flow guide further comprising a substantially V-shaped first end, the lowest point of which is at the opening of said ink hole to direct said collected ink coming from said chamber to flow through said ink hole when said fountain pen is held upright;

said ink flow guide further comprising an axial control hole having a flow portion with a bigger opening at an end opposite said first end;

a movably disposed gravity post having two rod ends, said gravity post being capable of blocking the passage of ink between said ink reservoir and said control hole; and a substantially cylindrical plug having a plurality of axial through grooves, said plug acting as a support for said gravity post inside said flow portion;

whereby when said fountain pen is vigorously shaken, said chamber will collect ink which may flow from said ink reservoir through said ink hole, and when said fountain pen is in an upright position, said collected ink will flow back into said ink reservoir through said ink hole.

2. A fountain pen as claimed in claim 1, further comprising a pen barrel with an air hole for communicating said vent hole with the atmosphere.

* * * * *